US006460905B2

(12) United States Patent
Süss

(10) Patent No.: US 6,460,905 B2
(45) **Date of Patent: *Oct. 8, 2002**

(54) INNER DOOR HANDLE FOR AUTOMOBILES

(75) Inventor: Peter Süss, Würzburg (DE)

(73) Assignee: ITW-Ateco G.m.b.H, Rottingen (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/564,570

(22) Filed: May 5, 2000

(65) Prior Publication Data

US 2002/0117865 A1 Aug. 29, 2002

(30) Foreign Application Priority Data

May 5, 1999 (DE) ..... 199 20 511

(51) Int. Cl.[7] ..... E05B 3/00
(52) U.S. Cl. ..... 292/336.3; 292/DIG. 61
(58) Field of Search ..... 292/DIG. 3, DIG. 23, 292/DIG. 30, DIG. 61, 336.3

(56) References Cited

U.S. PATENT DOCUMENTS 3,606,428 A * 9/1971 Erck et al. ..... 292/336.3
3,788,685 A * 1/1974 Leichtl ..... 296/65 A
4,580,822 A * 4/1986 Fukumoto ..... 292/336.3
4,778,207 A * 10/1988 Gergoe ..... 292/336.3
4,889,373 A * 12/1989 Ward et al. ..... 292/336.3
5,035,452 A * 7/1991 Rogers ..... 292/125
5,263,750 A * 11/1993 Smith et al. ..... 292/336.3
5,613,717 A * 3/1997 Ha ..... 292/336.3
5,887,918 A * 3/1999 Okada et al. ..... 292/336.3
5,895,081 A * 4/1999 Tanimoto et al. ..... 292/348
5,921,595 A * 7/1999 Brackmann et al. ..... 292/216
5,961,166 A * 10/1999 Edwards ..... 292/336.3

* cited by examiner

*Primary Examiner*—Jack Lavinder
*Assistant Examiner*—Benjamin A Pezzlo
(74) *Attorney, Agent, or Firm*—Lowe Hauptman Gilman & Berner, LLP

(57) ABSTRACT

Inner door handle for automobiles comprising a lever pivotably supported within a housing, a driving connection interconnecting the lever and a door lock, a return spring engaging the lever and biasing the lever towards a basic position if the lever is pivoted from the basic position to an opening position, the lever being adapted to be pivoted into an oppositely located locking position, characterized in that the return spring and the lever are structured such that the lever in the opening position is biased towards the basic position, the return spring, however, does not act on the lever in the locking position, a dead point spring being provided which biases the lever towards the locking position if it exceeds a dead point position upon movement from the basic into the locking position, the dead point spring biasing the lever towards the basic position on the opposite side of the dead point position of lever, the dead point spring being ineffective upon displacement of the lever into the opening position.

5 Claims, 3 Drawing Sheets

INNER DOOR HANDLE FOR AUTOMOBILES

TECHNICAL FIELD

The invention relates to an inner door handle for automobiles.

BACKGROUND ART

The inner door handle of automobiles commonly has a lever which is biased by a spring towards a basic position. The lever is linked to a door lock via a driving connection, e.g. a cord or linkage.

It is also known to bolt the lock by actuation of the lever. To this end, the lever when actuated is pivoted in a direction opposite to the direction of actuation to open the door, i.e. the lever is pivoted into the door. This causes the door lock to be bolted. Such a bolting is also effected when the lock is actuated by a remote operation where actuation may be electromagnetic or electromotive. In this case, the actuating lever is uncoupled from the driving connection. This will ensure that the locked door cannot be unlocked by a person who puts his hand to the inside from outside, perhaps through a broken window pane, in an attempt to pivot the lever to an opening position.

In known designs, because of clearance and frictional forces, there is a danger that the actuating lever or handle has a non-defined basic position. In addition, it needs to be ensured that the actuating lever, when in its locked position, also shows this by its position and does not return to its basic position. In known designs, the actuating lever is completely under no load in its locking position. Therefore, it might well happen that it returns to its basic position.

This object is attained by the features of claim 1.

SUMMARY OF THE INVENTION

The inner door handle of the invention provides two springs which act on the actuating lever. A return spring is structured so as to bias the actuating lever towards a basic position if it is pivoted to the opening position. On the other hand, both the lever and return spring are structured such that the return spring does not bias the actuating lever when the lever is in its locking position. This is achieved, amongst other things, by providing another spring, a dead point spring, which biases the lever towards the locking position. This bias is only obtained, however, if the actuating lever is moved from the basic position to the locking position and thereby exceeds a dead point position. Not until the dead point position is exceeded will the second spring make its action felt and bias the actuating lever towards the locking position. On the other hand, the second spring and the actuating lever are structured such that the lever, upon movement from the basic position to the locking position, will bias the dead point spring towards, the basic position after the lever exceeds the dead point position. This action will center the lever in the basic position regardless of whether there are tolerances or friction.

Thus, the inventive design has the advantage that the inner door handle is centered in its basic position, but this will simultaneously ensure that there is also a defined position in the locking position from which the handle cannot inadvertently be forced back independently to its basic position.

Various constructional types are imaginable in realizing the indicated teaching. In one aspect of the invention, the return spring which is rotatably supported in the housing has two legs. A first stop mounted on the lever is located between the legs. A second stop is between the legs as well, but is movable relative to a limited length guide of the housing and is biased by the dead point spring such that the dead point spring biases the second stop on both sides of the dead point position towards one end each of the guide. Finally, the lever has a cam portion which takes with it the second stop if the lever is pivoted from the basic position to the locking position. The return spring is preferably a helical spring the end of which is designed with legs of major length. The helical spring may be rotatably supported by a pin of the housing in order to be loosely carried along into the locking position upon pivoting the actuating lever to the locking position. When in the latter, only the dead point spring will act on the actuating lever.

In another aspect of the invention, the guide preferably has provided for it an arcuate slot in which a portion of the second stop is disposed, Thus, the second stop is a kind of a cam which is guided by the arcuate slot.

DETAILED DESCRIPTION OF THE INVENTION

Figure 1:
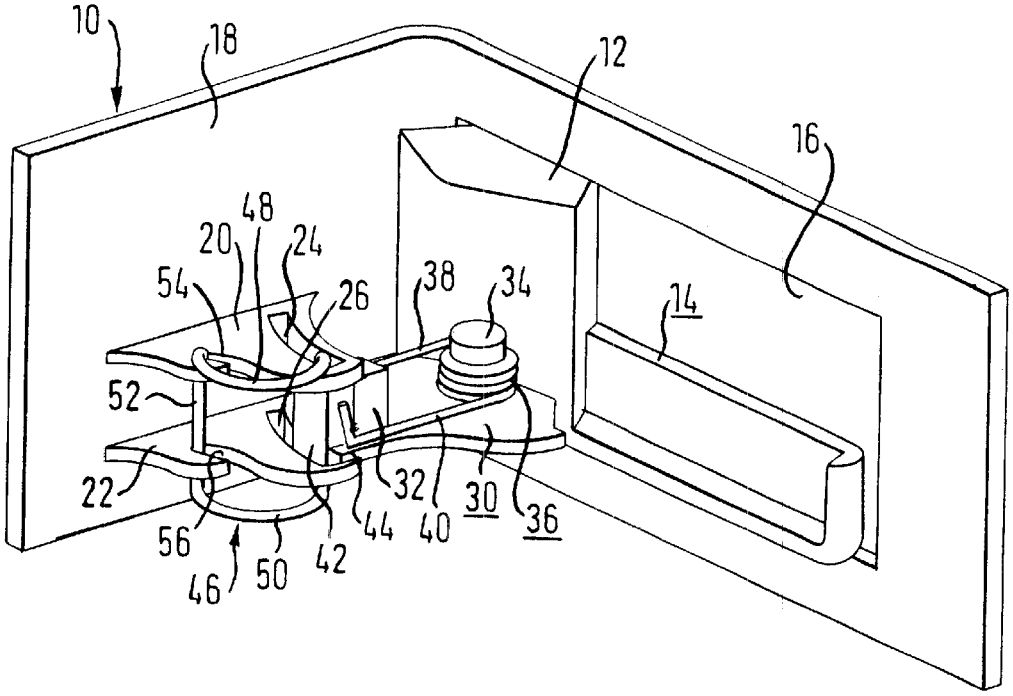
FIG. 1 shows a perspective schematic view of an inner door handle of the invention as seen from a door inside.

In a housing 10, an actuating lever 12 is pivotably supported about a vertical axis. Lever 12 has a handle portion 14 which may be gripped by hand from the inside of a door (not shown) of an automobile through an opening 16 in the housing. The manner of supporting lever 12 in housing 10 is not shown in detail.

Two brackets 20, 22 spaced in parallel are mounted at a spacing from lever 12 on a wall portion 18 of housing 10. Each bracket includes an arcuate spring receiving slot portion 24 and 26 superposed in congruence with each other.

Formed on lever 12 is an inwardly facing plate-shaped protrusion 30 which has an upwardly facing stop 32. Formed close to lever 12 on protrusion 30 is a circular cross-section pin 34 which rotatably supports a helical spring 36. Helical spring rests on protrusion 30. Helical spring 36 has arranged at its ends two parallel legs 38, 40 each of which is disposed on one side of stop 32. Arranged between legs 38, 40 is a second stop 42 the ends of which extend into slots 24, 26 in an approximately fitting relationship. At the free end of protrusion 30, there is a cam portion 44 which bears against the associated side of second stop 42 as is shown in FIG. 1.

A dead point spring 46 has two arcuate spring portions 48, 50 which are disposed in two parallel-spaced planes above and below brackets 20, 22 and are interconnected by a stem 52. The dead point spring 46, which is formed from wire, has its stem 52 received in appropriate recesses 54, 56 of brackets 20, 22. Dead point spring 46 is pivotable about the axis of stem 52.

The ends of arcuate spring portions 48, 50 engage the ends of the second stop 42 and, hence, are connected thereto.

The operation of the inner door handle is best appreciated from FIGS. 3 to 6. The reference figures used are identical as far as the components shown in the figures are the same as those of FIGS. 1 and 2.

Figure 2:
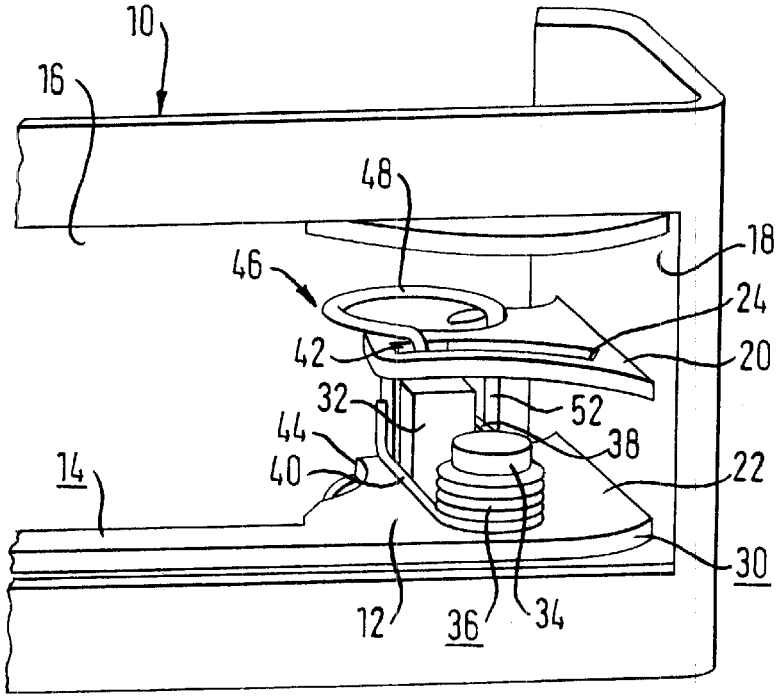
FIG. 2 shows the inner door handle of FIG. 1 as seen towards the interior of the door.
Figure 3:
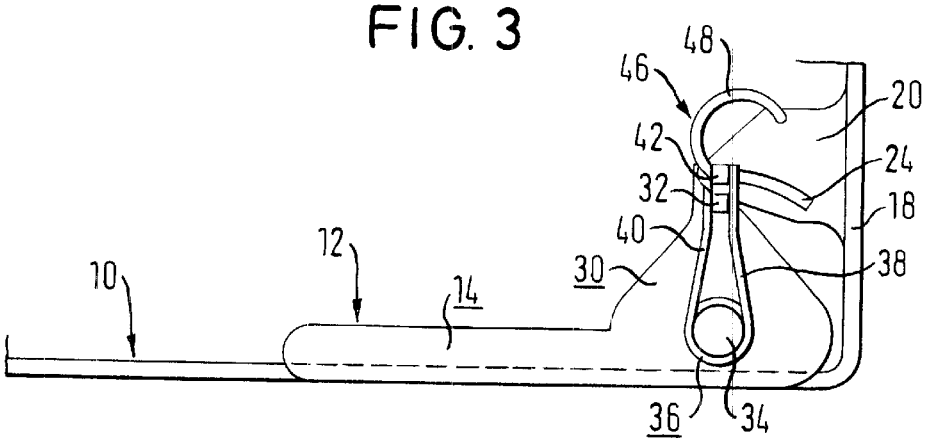
FIGS. 3 to 6 show a schematic view of the inner door handle of FIGS. 1 and 2 in different positions.
Figure 4:
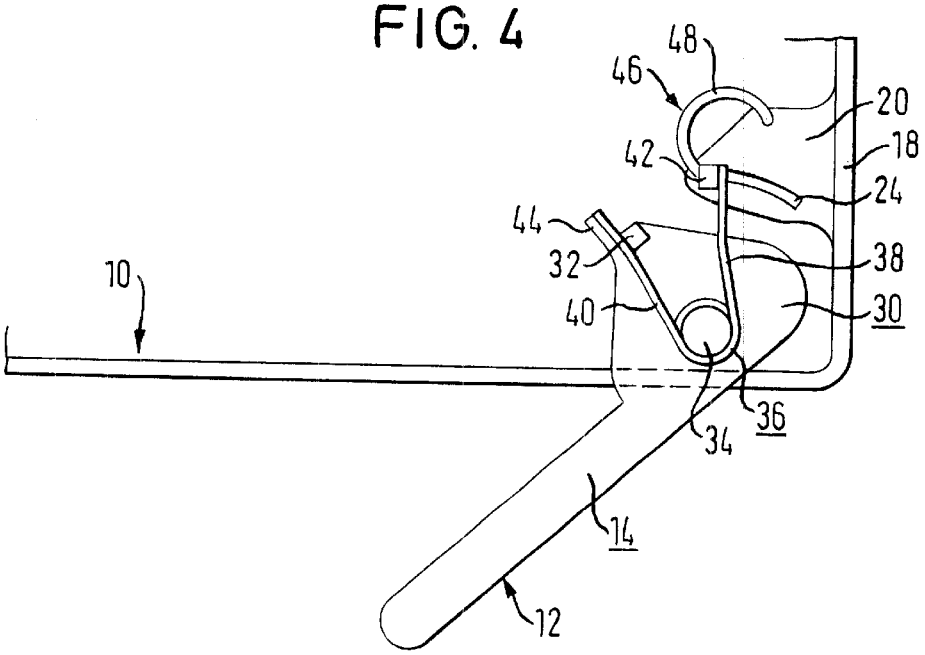

The representation of FIGS. 3 to 6 relies on the fact that the pivoting axis of lever 12 coincides with the axis of pin 34. FIG. 3 shows the basic position of the door handle or lever 12, which is also illustrated in FIGS. 1 and 2. If the handle portion of lever 12 is grasped by hand and is pulled into the interior of the automobile it will take a position according to FIG. 4. In this position, the door lock (not shown) will be opened via a driving connection linked to lever 12. Thus, the vehicle door may be opened.

Figure 5:
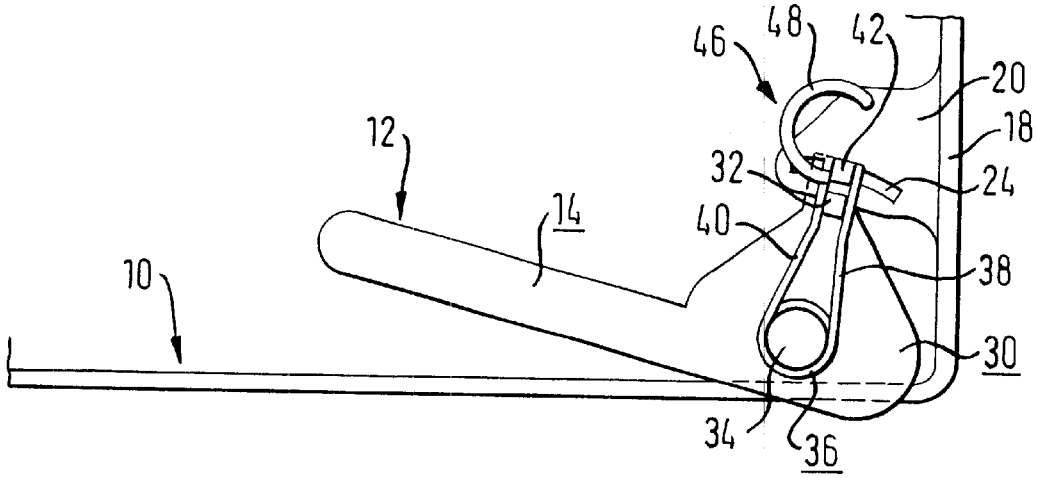
Figure 6:
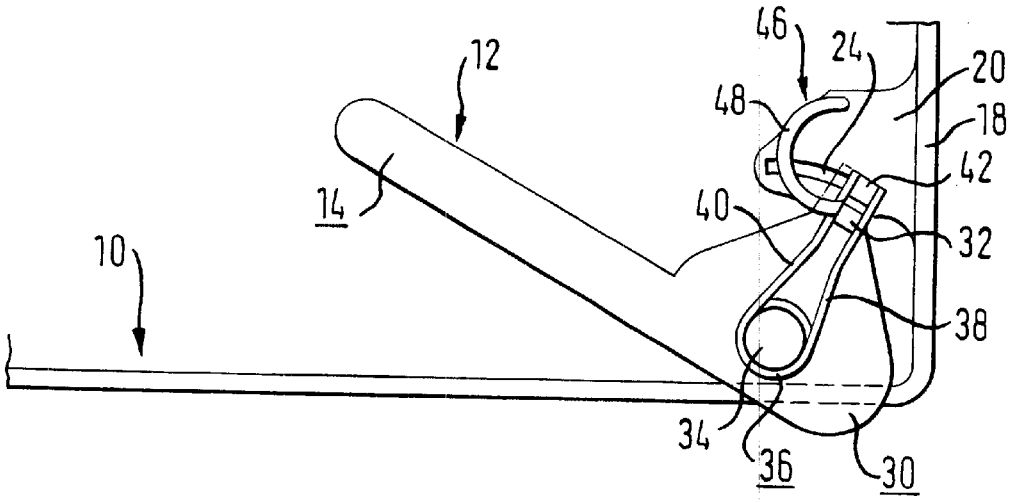

However, it is also possible to pivot lever 12 from the vehicle interior into the door as is shown in FIGS. 5 and 6. FIG. 6 shows the locking position in which the driving connection (not shown) bolts the door lock (not shown). This locking action may also be effected by a servo-mechanism via a remote actuation. In this case, lever 12 is uncoupled from the driving connection to enable unlocking by a manual operation of lever 12.

Helical spring 36 is rotatably supported on pin 34. Legs 38, 40 of spring 36 are located on the oppositely located sides of stops 32, 42, respectively. If the two stops are moved spring 36 will move as well with no force action being produced by this spring. Dead point spring 46 is a compression spring which will undergo maximum slackening when stop 42 to which spring 46 is connected is at the ends of arcuate slot 24. In an intermediate position shown in FIG. 5 in which lever 12 has a dead point position, spring 46 is compressed to a maximum and so are its spring portions 48, 50, to be precise. Hence, it can be seen that stop 42 is biased either towards one end or towards the other end of slot 24 at either side of the dead point position of FIG. 5.

What is obvious from the above explanation is that if lever 12 is in its basic position stop 42 is biased against the left-hand end of slot 24. Since the stop is located between legs 38, 40 it keeps lever 12 in the position shown in FIG. 3 because stop 32, which is firmly connected to lever 12, is also located between spring legs 3 8, 40. Any pivoting motion of lever 12 in either sense of rotation may only be effected against a spring force. Pivoting in an opening direction causes leg 40 to be moved with the lever, viz. via stop 32. Therefore, lever 12 is biased in a clockwise sense or a sense of return. At this point, the other leg is supported on stop 42.

When lever 12 is rotated clockwise, cam portion 44 of lever 12 interacts with second stop 42 to move it along slot 24 as shown in FIG. 5. This causes arcuate spring portions 48, 50 to jointly undergo more bending until the dead point position of FIG. 5 is reached. If the lever continues to be rotated clockwise as is shown in FIG. 5 a slackening may occur on spring portions 48, 50, which entails that second stop 42 is biased towards the right-hand, end of slot 24. During this rotation of lever 12, spring 36 is turned by leg 38 which bears against stop 32. A force action is not produced by spring legs 38, 40. In any case, however, lever 12 is also biased in the locking position of FIG. 6, viz. via spring 46, too. If lever 12 is pivoted-back to the basic position, i.e. by turning it counterclockwise, spring leg 38 will take with it second stop 42 because first stop 32 tries to distort spring 36 via leg 40. This will also cause dead point spring 46 to undergo more compression. The force required to do so, however, is not so large as to make it impossible for second stop 42 to move along slot 24 towards the left-hand end. Once the dead point position of FIG. 5 is passed over spring 46 produces a counterclockwise bias to lever 12 in order to move it back towards the basic position of FIG. 3.

What is claimed is:

1. An automobile inner door handle, comprising:

a lever supported within a housing to be pivotable between an opening position and a locking position via a basic position located between the opening and locking positions;

a driving connection interconnecting the lever and a door lock;

a return spring engaging the lever and biasing the lever towards the basic position if the lever is pivoted from the basic position to the opening position, wherein the return spring and the lever are structured such that the lever in the opening position is biased towards the basic position, and the return spring does not act on the lever in the locking position; and a two way action dead point spring which biases the lever towards the locking position if the lever exceeds a dead point position upon movement from the basic position into the locking position, the two way action dead point spring biasing the lever towards the basic position on an opposite side of the dead point position of the lever, the two way action dead point spring being ineffective upon displacement of the lever into the opening position.

2. An automobile inner door handle, comprising:

a lever supported within a housing to be pivotable between an opening position and a locking position via a basic position located between the opening and locking positions and a dead point position located between the basic and locking positions;

a driving connection interconnecting the lever and a door lock;

a return spring engaging the lever and biasing the lever towards the basic position if the lever assumes a position between the basic position and the opening position, wherein the return spring does not act on the lever if the lever assumes a position between the basic and locking positions; and a dead point spring biasing the lever towards the locking position if the lever assumes a position between the dead point and locking positions, the dead point spring biasing the lever towards the basic position if the lever assumes a position between the dead point and basic positions, wherein the dead point spring does not act on the lever if the lever assumes a position between the basic and opening positions;

wherein the return spring is rotatably supported and includes two legs;

said automobile inner door handle further comprises a first stop on the lever and located between the legs, and a second stop located between the legs and movable relative to a guide member of the housing;

the dead point spring biases the second stop on both sides of the dead point position towards respective opposite ends of the guide member; and said automobile inner door handle further comprises a cam portion provided on the lever for engaging the second stop and traveling therewith if the lever is pivoted from the basic position into the locking position.

3. The handle of claim 1, wherein the return spring is a coil spring.

4. The handle of claim 2, wherein the dead point spring includes an arcuate spring portion having one end connected to the second stop and an opposite end linked to the housing.

5. The handle of claim 2, wherein the guide member includes an arcuate slot guiding the second stop.

* * * * *